United States Patent [19]

Rodriguez

[11] Patent Number: 5,075,915

[45] Date of Patent: Dec. 31, 1991

[54] ERASER CLEANER

[76] Inventor: Juan M. R. Rodriguez, 51 Independencia #18, La Vega, Dominican Republic

[21] Appl. No.: 541,218

[22] Filed: Jun. 22, 1990

Related U.S. Application Data

[63] Continuation of Ser. No. 211,212, Oct. 24, 1988, abandoned.

[51] Int. Cl.[5] ..... A47L 25/00; A47L 13/502; B43L 21/02

[52] U.S. Cl. ..... 15/89; 15/77

[58] Field of Search ..... 15/89, 91, 21.1, 88.1, 15/88.2, 88.3, 77, 308

[56] References Cited

U.S. PATENT DOCUMENTS 2,896,234 7/1959 Hennefer ..... 15/89
2,962,741 12/1960 Petrillo ..... 15/77 X
3,102,290 9/1963 Sannes ..... 15/77 X
3,289,682 12/1966 Naslund ..... 15/77 X
4,392,268 7/1983 Bueno ..... 15/91

FOREIGN PATENT DOCUMENTS

WO8604302 7/1986 World Int. Prop. O. ..... 15/89

*Primary Examiner*—Edward L. Roberts
*Attorney, Agent, or Firm*—Roylance, Abrams, Berdo & Goodman

[57] ABSTRACT

A teacher's eraser cleaner having a housing with a first opening for receiving an eraser into the housing, and a second opening for removing the eraser from the housing. The housing has a cleaning mechanism position therein for removing dust particles from the eraser as it passes through the housing. A conveyor mechanism is utilized for moving the eraser through the housing.

12 Claims, 3 Drawing Sheets

ERASER CLEANER

This is a continuation of application Ser. No. 211,212, filed Oct. 24, 1988, now abandoned.

BACKGROUND OF THE INVENTION

1. Field of the Invention

This invention is directed to a device for cleaning chalkboard dust from a conventional blackboard eraser commonly used by grade school teachers and university professors.

2. Prior Art

In schools and universities, it is common practice for teachers to use blackboards or other chalkboards to convey information to their students. The chalk-written information is then removed by hand manipulated erasers.

Before this invention, it has been common practice to clean blackboard erasers by clapping the erasers together or hitting the erasers against a wall or any other surface. This method gets the erasers clean, but it leads to getting chalk dust all over the hands, face and the clothes of the user. Also the dust gets all over the floors and walls of the building at the time that the cleaning takes place. Accordingly, this is a very messy, time-consuming and unsatisfactory approach to cleaning erasers.

Accordingly, this invention addresses this need in the art, as well as other needs which will become apparent to those skilled in the art once given this disclosure.

3. Summary of the Invention

A primary object of this invention is to provide a device for cleaning the blackboard erasers which may be used by school teachers and university professors such that eraser is contained within a housing to prevent dust from being expelled out into the surrounding area.

Another object of this invention is to provide an eraser cleaner that will collect the dust from the eraser in a compartment which may be emptied at the user's convenience.

These objects of this invention are basically attained by an eraser cleaner for removing chalkboard dust from a conventional blackboard eraser, comprising: a housing having a first opening for receiving an eraser entering into the housing, a second opening for receiving an eraser exiting from the housing and a cleaning area positioned between the first and second openings; a cleaning mechanism located within the cleaning area of the housing for removing chalkboard dust from an eraser entering the housing through the first opening and exiting the housing through the second opening; and a conveying mechanism coupled to the housing for moving an eraser entering the housing through the first opening through the cleaning area, past the cleaning mechanism and out of the housing through the second opening.

Other objects, advantages and salient features of the invention will become apparent from the following detailed description, which, taken in conjunction with the annexed drawings, discloses a preferred embodiment of the present invention.

BRIEF DESCRIPTION OF THE DRAWINGS

Referring to the drawings, which form part of this disclosure.

DETAILED DESCRIPTION OF THE PREFERRED EMBODIMENT

Before explaining the present invention in detail, it should be understood that the invention is not limited in its application to the details of construction and arrangement of parts illustrated in the accompanying drawings, since the invention is capable of other embodiments and being practiced or carried out in a variety of ways.

Figure 1:
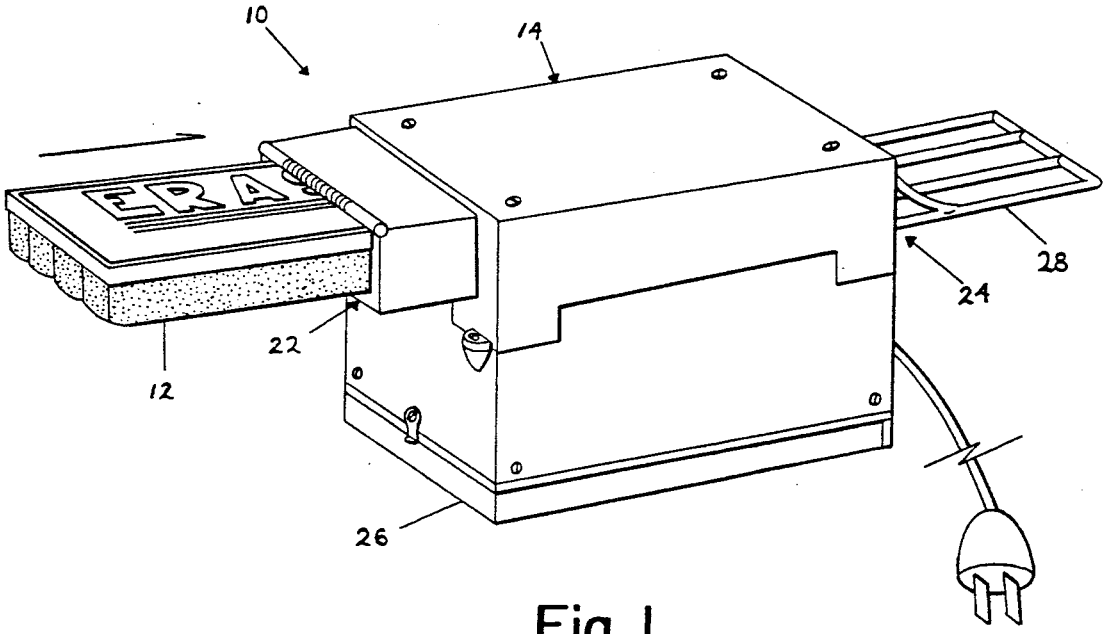
FIG. 1 is a perspective view of an eraser cleaner in accordance with the present invention receiving an eraser therein to be cleaned.
Figure 2:
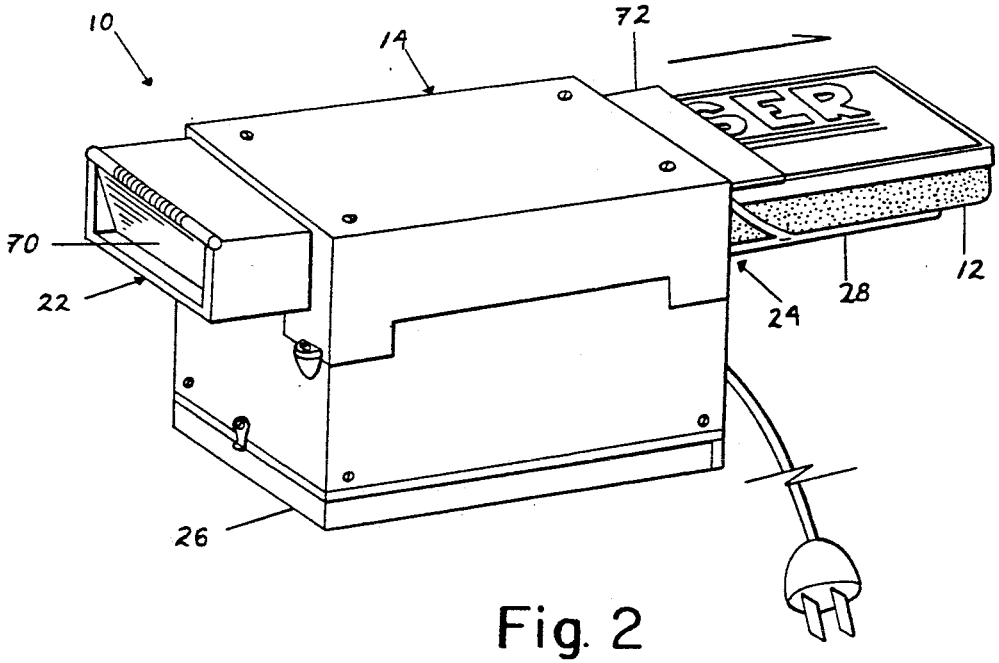
FIG. 2 is a perspective view of the eraser cleaner illustrated in FIG. 1 with a cleaned eraser being ejected therefrom.

Referring to FIG. 1, an eraser cleaner 10 is illustrated in accordance with this invention for cleaning a blackboard eraser 12. The majority of these erasers are made of compressed wool or cotton. The compressed material is adhered to a board made out of plastic or wood. Typically, an eraser has a width of about 5.20 cm, a height of about 2.20 cm and a length of about 13.20 cm.

Basically, the eraser cleaner 10 includes a housing 14, a drive mechanism 16 coupled within housing 14, a cleaning mechanism 18 located within housing 14 for removing chalkboard dust from eraser 12, and a conveying or transporting mechanism 20 located within housing 14 for moving eraser 12 through housing 14 past cleaning mechanism 18.

Figure 3:
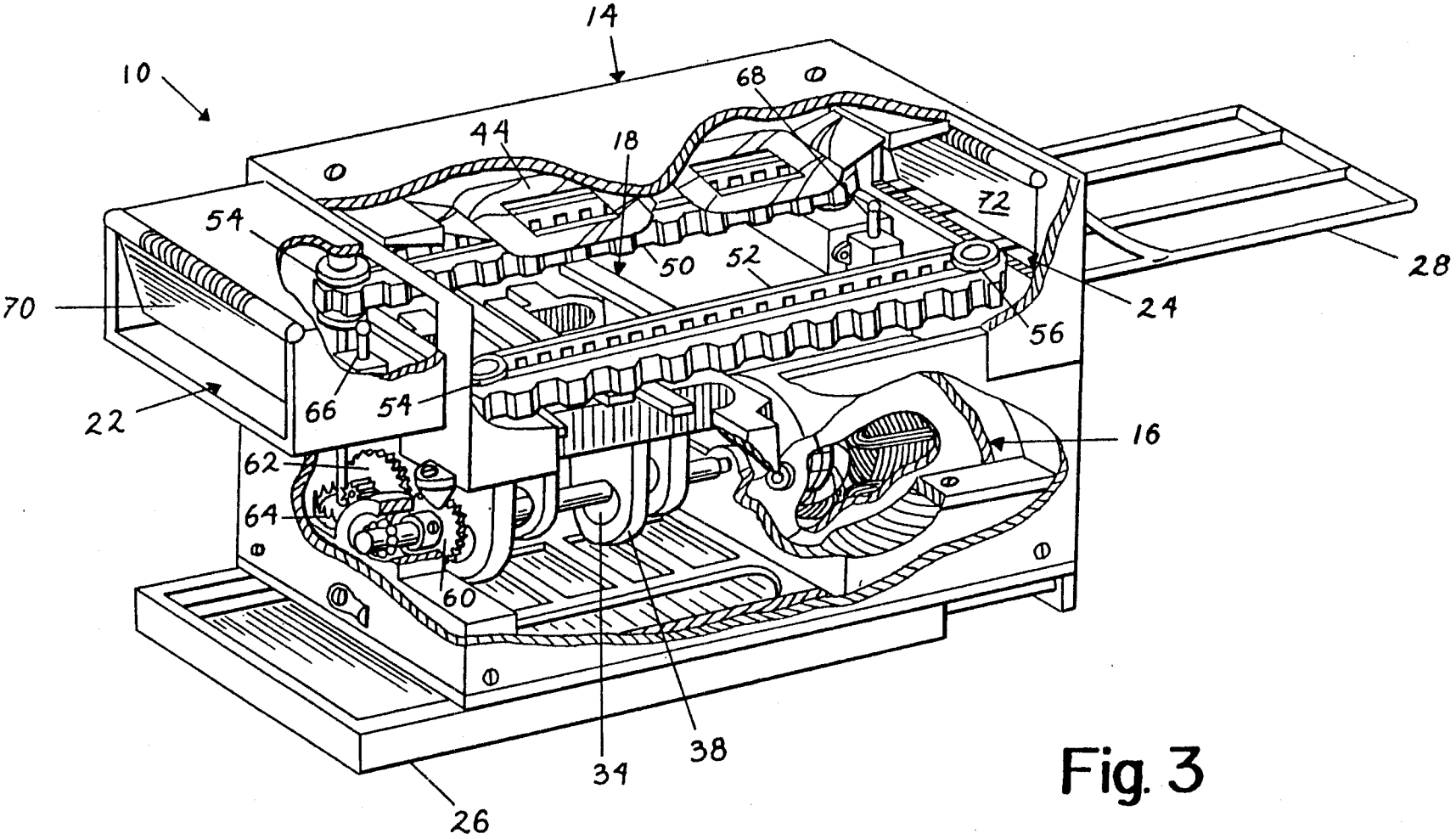
FIG. 3 is an enlarged perspective view of the eraser cleaner illustrated in FIG. 1 with certain parts being removed for clarity.
Figure 4:
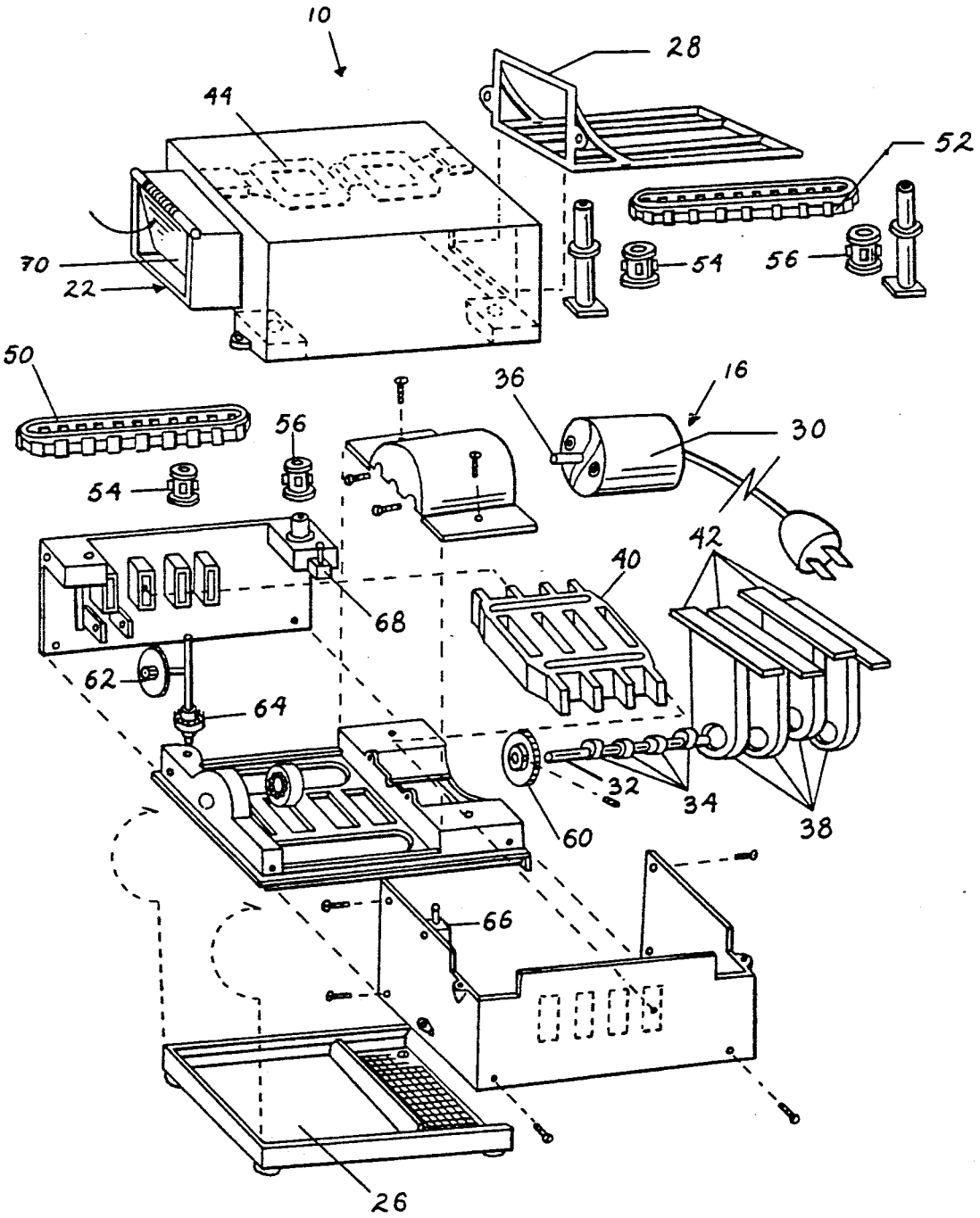
FIG. 4 is an exploded perspective view of the eraser cleaner illustrated in FIGS. 1-3.

As particularly seen in FIG. 3, housing 14 has a first opening 22 for introducing eraser 12 into housing 14 and a second opening 24 aligned with first opening 22 for expelling eraser 12 from housing 14 after being cleaned by cleaning mechanism 18. Housing 14 also has a lower dust collecting compartment 26 slidably coupled in a conventional manner to the bottom of housing 14 for collecting the chalkboard dust removed from the erasers being cleaned. Collecting compartment 26 allows for removal of the chalkboard dust at the user's convenience.

A exterior grill 28 is rigidly coupled to the exterior of housing 14 and located below second opening 24 for supporting eraser 12 as it exits from housing 14 through second opening 24.

Drive mechanism 16 includes an electric motor 30 rigidly coupled to the interior of housing 14, a crankshaft 32 with four cam disk 34 fixedly coupled to an output shaft 36 of motor 30, four reciprocating members 38 coupled to a crankshaft 32 at the cam disks 34, and a cylinder plate 40 rigidly coupled to housing 14 for supporting reciprocating members 38.

Cleaning mechanism 18 includes four flat rectangular elements 42 with each of the elements 42 being rigidly coupled to one of the reciprocating members 38, and a spring 44 coupled to the interior surface of the top wall of housing 14 for pressing eraser 12 down against elements 42 as they reciprocate against the eraser 12.

Conveying mechanism 20 includes a pair of transporting or conveying rails 50 and 52 for moving eraser 12 through the cleaning area in housing 14. Each of the rails 50 and 52 are movably supported by a pair of pulleys 54 and 56 which are rotatably coupled to housing 14 in a conventional manner. Pulley 54 of rail 50 is driven by motor 30 through three gears 60, 62 and 64 which are rotatably supported in a conventional manner. Accordingly, rail 50 is driven by motor 30, while rail 52 is free to move by contacting eraser 12.

A pair of internal switches 66 and 68 are coupled to housing 14 adjacent openings 22 and 24, respectively. Switch 66 activates motor 30, when an eraser is inserted into opening 22 and contacts switch 66. Once motor 30 is activated, then the cleaning mechanism 18 and the conveying mechanism 20 are also activated. The eraser 12 is conveyed through the cleaning area of the housing 14 by rails 50 and 52, and is pushed out of housing 14 through opening 24. As the eraser 12 exits housing 14, the eraser 12 contacts switch 68 which then turns off motor 30.

A door 70 is pivotally coupled to housing 14 for closing opening 22 to prevent dust from escaping housing 14 through opening 22. Similarly, a door 72 is pivotally coupled to housing 14 for closing opening 24 to prevent dust from escaping housing 14 through opening 24.

OPERATION

The eraser 12 enters housing 14 through opening 22 where it contacts internal switch 66 to turn on motor 30, thereby producing a synchronized mechanical cleaning cycle. The eraser 12 is advanced by rails 50 and 52. The surfaces of the rails 50 and 52 that touches the eraser 12 are wavy in form and flexible. The waves grip the eraser to avoid slipping, while the flexibility permits the entrance of erasers of different widths. The height of the erasers is controlled by spring 44 which presses down on the eraser such that the bottom of the eraser contacts the flat elements 42 as they go up and down at great speed to hit the surface of the compress material of the eraser, which contains the dust particles of the chalk. The vibration produced by cleaning mechanism 18 removes the dust particles, which fall downwardly and accumulate in compartment 26. The electrical energy to the motor 30 is then disconnected when the eraser 12 contacts switch 68 as it exits housing 14 through opening 24.

What is claimed is:

1. An eraser cleaner for removing chalkboard dust from a conventional blackboard eraser, comprising:

a housing having a first opening for receiving an eraser entering into said housing, a second opening for receiving an eraser exiting from said housing, and a cleaning area positioned between said first and second openings;

cleaning means, located within said cleaning area of said housing, for removing chalkboard dust from an eraser by vibrating the eraser entering said housing through said first opening and exiting said housing through said second opening, said cleaning means operating without liquid; and conveying means, coupled to said housing, for moving an eraser entering said housing through said first opening through said cleaning area, past said cleaning means and out of said housing through said second opening.

2. An eraser cleaner according to claim 1, wherein said housing includes a first door pivotally coupled to said housing for selectively covering said first opening and a second door coupled to said housing for selectively covering said second opening.

3. An eraser cleaner for removing chalkboard dust from a conventional blackboard eraser, comprising:

a housing having a first opening for receiving an eraser entering into said housing, a second opening for receiving an eraser exiting from said housing, a first door pivotally coupled to said housing for selectively covering said first opening, and second door coupled to said housing for selectively covering said second opening, and a cleaning area positioned between said first and second openings;

cleaning means, located within said cleaning area of said housing, for removing chalkboard dust from an eraser entering said housing through said first opening and exiting said housing through said second opening, said cleaning means including a plurality of reciprocating elements located in said housing for vibrating an eraser passing through said cleaning area of said housing; and conveying means, coupled to said housing, for moving an eraser entering said housing through said first opening through said cleaning area, past said cleaning means and out of said housing through said second opening.

4. An eraser cleaner according to claim 3, wherein said conveying means includes a pair of flexible rails extending between said first opening and said second opening for contacting and transporting an eraser passing through said cleaning area of said housing.

5. An eraser cleaner according to claim 3, wherein said housing has a first internal switch located adjacent said first opening such that an eraser entering said first opening contacts said first internal switch to activate said conveying means and said cleaning means, and a second internal switch located adjacent said second opening such that an eraser exiting said housing through said second opening contacts said second internal switch to deactivate said conveying means and said cleaning means.

6. An eraser cleaner according to claim 5, wherein said housing includes a dust compartment coupled thereto for collecting dust from erasers passing through said housing.

7. An eraser cleaner according to claim 6, wherein said housing has a motor located therein for driving said conveying means and said cleaning means.

8. An eraser cleaner for removing chalkboard dust from a conventional blackboard eraser, comprising:

a housing having a first opening for receiving an eraser entering into said housing, a second opening for receiving an eraser exiting from said housing, and a cleaning area positioned between said first and second openings;

cleaning means, located within said cleaning area of said housing, for removing chalkboard dust from an eraser entering said housing through said first opening and exiting said housing through said second opening, said cleaning means including a plurality of reciprocating elements located in said housing for vibrating an eraser passing through said cleaning area of said housing; and conveying means, coupled to said housing, for moving an eraser entering said housing through said first opening through said cleaning area, past said cleaning means and out of said housing through said second opening.

9. An eraser cleaner according to claim 8, wherein said conveying means includes a pair of flexible rails extending between said first opening and said second opening for contacting and transporting an eraser passing through said cleaning area of said housing.

10. An eraser cleaner according to claim 8, wherein said housing has a first internal switch located adjacent said first opening such that an eraser entering said first opening contacts said first internal switch to activate said conveying means and said cleaning means, and a second internal switch located adjacent said second opening such that an eraser exiting said housing through said second opening contacts said second internal switch to deactivate said conveying means and said cleaning means.

11. An eraser cleaner according to claim 10, wherein said housing includes a dust compartment coupled thereto for collecting dust from erasers passing through said housing.

12. An eraser cleaner according to claim 11, wherein said housing has a motor located therein for driving said conveying means and said cleaning means.

* * * * *